US005186316A

United States Patent [19]

Mortun et al.

[11] Patent Number: 5,186,316

[45] Date of Patent: Feb. 16, 1993

[54] STABLE-ON PUSH-PUSH ELECTRICAL SWITCH

[75] Inventors: Sorin Mortun, Irvington, N.Y.; Jacob Rosales, Nutley, N.J.

[73] Assignee: Lee Craft Manufacturing Co., Inc., Long Island City, N.Y.

[21] Appl. No.: 805,550

[22] Filed: Dec. 10, 1991

Related U.S. Application Data

[63] Continuation-in-part of Ser. No. 583,227, Sep. 14, 1990, abandoned.

[51] Int. Cl.[5] ..... H01H 13/56

[52] U.S. Cl. ..... 200/527; 200/276.001

[58] Field of Search ..... 200/276.1, 526, 527, 200/528

[56] References Cited

U.S. PATENT DOCUMENTS

| | | | |
|---|---|---|---|
| 3,694,603 | 9/1972 | Congelliere et al. | 200/526 |
| 4,175,222 | 11/1979 | Buttner | 200/528 |
| 4,225,764 | 9/1990 | Buttner | 200/526 X |
| 4,230,921 | 10/1980 | Wearing et al. | 200/526 |
| 4,317,015 | 2/1982 | Buttner et al. | 200/526 |
| 4,345,128 | 8/1982 | Buttner et al. | 200/526 |
| 4,891,476 | 1/1990 | Nation et al. | 200/526 |
| 4,906,808 | 3/1990 | Burgess et al. | 200/527 |
| 4,939,328 | 7/1990 | Smith | 200/526 |
| 4,950,856 | 8/1990 | Valenzona | 200/526 |
| 4,985,605 | 1/1991 | Valenzona | 200/528 |
| 4,996,401 | 2/1991 | Park | 200/527 |
| 4,997,999 | 3/1991 | Valenzona | 200/510 |
| 5,001,316 | 3/1991 | Salaman | 200/527 |
| 5,049,709 | 9/1991 | Prickett et al. | 200/527 |

*Primary Examiner*—Ernest G. Cusick

*Attorney, Agent, or Firm*—Glenn F. Ostrager; Dennis M. Flaherty

[57] ABSTRACT

An index rotary switch has a distributor which undergoes stepped rotation in response to longitudinal displacement of a plunger. The distributor is coupled to the plunger via a conventional tooth and cam arrangement to produce a 45-degree stepped rotation of the distributor in response to each up-down reciprocation of the plunger. A spring is arranged between a radial annular surface of an actuator cam follower and the radial annular flange of the distributor. The distributor is a unitary component made of electrically conductive material and having four radial extension arms spaced at equal angular intervals. At each of eight predetermiend stepped angular positions of the distributor, one radial extension arm engages a first electrical contact, another radial extension arm angages an insulating part, and the remaining two radial extension arms engage respective contact portions of either a second or a third electrical contact. The distributor sits atop and is urged against the electrical contacts by the spring.

7 Claims, 11 Drawing Sheets

STABLE-ON PUSH-PUSH ELECTRICAL SWITCH

RELATED APPLICATION

This application is a continuation-in-part of U.S. patent application Ser. No. 07/583,227 filed on Sep. 14, 1990, now abandoned.

DESCRIPTION

1. Field of Invention

This invention generally relates to push-push electrical switches suitable for remote control of lights or other electrical devices requiring low current flow through the switch. In particular, it relates to a pushbutton-actuated rotatably indexed miniature electrical switch which converts longitudinal motion of a plunger into stepped circumferential rotation of a rotor means to alternately effect interconnection of one contact with either of two other contacts.

2. Background Art

Numerous different push-push electrical switches are known wherein longitudinal motion of a plunger is converted into movement of a bridging element to alternately effect interconnection and disconnection of contact elements. For example, a push-push electrical switch is disclosed in U.S. Pat. No. 2,451,105 to MacNamara wherein successive actuation of a pushbutton to produce alternate "on" and "off" positions thereof is achieved by converting longitudinal movement of a plunger into rotary movement of a rotor means using a pawl and ratchet wheel arrangement. The plunger does not move in a direction along the axis of rotation. Using this mechanism, a rotary contactor having four mutually perpendicular arms is rotated in steps of 45 degrees, the successive steps alternately engaging and disengaging two diametrally opposed arms to a pair of contacts.

Alternatively, many conventional push-push electrical switches have a tooth and cam arrangement. Such push-push switches convert the longitudinal motion of a plunger into corresponding rotation and longitudinal displacement of a latching element and corresponding motion of a contact means. These push-push switches fall into at least three categories: (1) those wherein the contact means is moved back and forth longitudinally without rotation; (2) those wherein the contact means undergoes stepped circumferential rotation without longitudinal displacement; and (3) those wherein the contact means is moved back and forth longitudinally with stepped circumferential rotation.

For example, a push-push electrical switch with tooth and cam arrangement of the first type is disclosed in U.S. Pat. No. 3,694,603 to Congelliere et al. In accordance with this teaching, successive longitudinal displacement of a pushbutton produces alternate "on" and "off" positions. This is achieved by alternately latching and unlatching a longitudinally displaceable bridging element (thimble) using a tooth and cam arrangement. As a result, a contact flange of an axially displaceable thimble alternately engages and disengages a pair of resilient contacts. The switch has a single spring which urges the thimble away from the contacts.

U.S. Pat. No. 4,288,670 to Buttner discloses a push-push electrical switch similar to that of U.S. Pat. No. 3,694,603, except that the axially displaceable bridging element is latched out of contact with the contacts and unlatched into contact with the contacts, the spring urging the bridging element toward the contacts.

Another push-push electrical switch wherein longitudinal motion of a plunger is converted into longitudinal displacement without rotation of the contact means by means of a tooth and cam arrangement is disclosed in U.S. Pat. No. 4,319,106. In accordance with this teaching, a first spring urges the contact means away from the contacts and a second spring having a spring force three times that of the first spring is arranged between the contact means and the rotor.

A further push-push switch of the first type disclosed in U.S. Pat. No. 4,230,921 to Wearing et al. has a complex arrangement of four springs.

A push-push switch of this second type is disclosed in U.S. Pat. No. 4,293,751 to Van Benthuysen et al. In accordance with this teaching, a rotor with four equally circumferentially distributed resilient contactor paddles is rotated in response to longitudinal displacement of a plunger by means of a tooth and cam arrangement. In response to each up-down traversal by the plunger, the rotor is rotated by an angle of 45 degrees. The contactor plate is comprised of three contactor elements respectively connected to three electrical terminals. The contactor elements have areas circumferentially distributed in sequence in a peripheral annular ring which the contactor paddles wipe across during rotation of the rotor. Thus, the rotor has eight different angular positions. At each position all four contactor paddles are in contact with the contactor plate. In the four odd angular positions, two adjacent paddles contact respective portions of the first contactor element and the other two paddles contact respective portions of the second contactor element; in the four even angular positions, two adjacent paddles contact the respective portions of the second contactor element and the other two paddles contact respective portions of the third contactor element. Thus, in the odd angular positions the rotor interconnects the first and second contactor elements and in the even angular positions the rotor interconnects the second and third contactor elements. The switch of U.S. Pat. No. 4,293,751 has only one spring, which serves to resist the downward longitudinal displacement of the plunger. Because the contact paddles are resilient, no spring is necessary to urge the rotor toward the contact plate.

The push-push electrical switch disclosed in U.S. Pat. No. 4,891,476 to Nation et al. has all of the above-described features disclosed in U.S. Pat. No. 4,293,751. One structural difference, however, is that the spring of U.S. Pat. No. 4,891,476 is seated on top of the rotor, whereas the spring in U.S. Pat. No. 4,293,751 passes through a central opening in the rotor.

Another switch of the type wherein the contact means undergoes stepped rotation without longitudinal displacement is disclosed in U.S. Pat. No. 3,204,067 to Brown. A cruciform electrically conductive switching member 15 has arms adapted to engage selected contacts during rotation. Two of the arms have flanges which are received in grooves of the rotor 19 such that rotation of the rotor is imparted to the conductor 15. Although a spring 23 is arranged between the conductor 15 and the rotor 19, the conductor 15 is not slidably arranged within a bore of the rotor.

The Park patent teaches a switch having a moveable contact 50 which undergoes stepped rotation without longitudinal displacement. The moveable contact is coupled with a contact holder in a manner similar to that disclosed in the Brown patent, except that the flange-like sections which engage grooves in the contact holder also serve as the contact means. The contact sections of contact 50 alternatingly engage U-shaped fixed contacts for switching therebetween and are always electrically connected to the central conductor during rotation. A spring is arranged between contact holder 46 and the intermediate member 34 of the actuator 30

Finally, a push-push electrical switch of the third type is disclosed in U.S. Pat. No. 4,939,328 to Smith. In accordance with this teaching, a contact cup with four equally circumferentially distributed extension ears undergoes longitudinal displacement and stepped rotation in response to longitudinal displacement of a plunger. In response to each up-down traversal by the plunger, the contact cup is rotated by an angle of 45 degrees. The function of the contact cup is to alternatingly interconnect first and second input terminals to a common input terminal. The common input terminal is always electrically coupled to the contact cup by way of a spring arranged inside the contact cup. The first and second input terminals are located such that each extension ear will first contact the first input terminal and then, after three successive 45-degree rotation of the contact cup, contact the second input terminal. Since the extension ears are separated by angles of 90 degrees, the contact cup will alternatingly contact the first and second input terminals during successive 45-degree rotations. Thus, in the odd angular positions the contact cup interconnects the first and common input terminals and in the even angular positions the contact cup interconnects the second and common input terminals. The switch of U.S. Pat. No. 4,939,328 has two springs, one of which urges the contact cup in the direction of engagement with the first and second input terminals and the other of which counteracts a portion of the force exerted by the first spring on the contact cup for reducing the operating noise level.

Some of the above-discussed prior art push-push switches suffer from the disadvantage that the contacts have a short life. For example, some index rotary switches which utilize longitudinally reciprocating and rotating contact to make and break point-to-point type contact with stationary contacts have short contact life. If there is a lack of precision in the making and breaking of contacts in the switch operation, a slow disengagement time will produce excessive heating and wear of the contact elements in addition to arcing and corrosion.

Furthermore, even in the absence of contact degradation, the current carrying capacity of some conventional index rotary switches is limited to low levels because of the limited contact area of the single pair of contacts. Such switch design is also susceptible to spurious actuation when subjected to vibrations.

Another disadvantage of prior art push-push switches is the excessive number of components, which complicates the manufacture and assembly of the device and adds to the cost of manufacture and maintenance. A further disadvantage which attends the large number of components in the switch is imprecision in assembly attributable to the cumulative effect of multiple tolerances. Because each component varies in dimension and finish, proper assembly is complicated, requiring wasteful adjustments and increasing the number of rejects. In particular, imprecision in the cooperation between components can lead to failure of the rotary contact to undergo a stepped rotation in response to longitudinal reciprocation of the plunger.

A disadvantage of push-push switches in which the distributor reciprocates longitudinally for alternating engagement and disengagement with the contact elements is that an unstable ON position can be attained when the plunger does not traverse its full stroke. It is possible for the user to push the plunger down a distance sufficient to cause the switch to attain the ON state without the peaks of the opposing teeth of the actuator and housing sliding past each other. Once the switch reaches this unstable ON position, the user may release the plunger prematurely. The result is that instead of the distributor rotating further in the direction of rotation, when the plunger displaces upwardly the distributor reverses its direction of rotation. Thus, instead of arriving at a stable ON position, the distributor returns to the stable OFF position. This has the disadvantage of misleading the user to believe that the switch is malfunctioning, when instead the user has failed to operate the switch properly.

DISCLOSURE OF THE INVENTION

It is an object of the invention to overcome the aforementioned disadvantages of conventional push-push electrical switches. In particular, it is an object of the invention to provide a switch which is easy to operate and has relatively few components, resulting in a relatively low cost of manufacture.

Another object of the invention is to provide a simple push-push electrical switch wherein the components are precisely assembled to ensure positive circuit disconnection.

Yet another object of the invention is to provide a switch wherein the distributor is abruptly disengaged from the engaged contact element, thereby ensuring a positive electrical disconnection therefrom.

A further object of the invention is to provide a switch free of unstable ON positions. This avoids the problem of the user releasing the plunger prematurely when the switch attains the unstable ON position.

Yet another object of the invention is to provide a switch wherein a rotary contact cup effects controlled engagement and disengagement of electrical contact members to thereby prolong contact life, limit contact degradation and associated resistive intermittancy.

A further object of the invention is to provide a push-push switch wherein the extension arms of the distributor and the stationary contact elements define an infinite number of alternating "on" and "off" positions during stepped rotation of the distributor.

Yet another object of the invention is to provide an index rotary switch with redundant electrical contacts which effectively double the current carrying capacity of the switch as compared to that of a switch with a single contact.

In the present invention, these objects, as well as others which will be apparent, are achieved generally by providing an index rotary switch wherein a distributor undergoes stepped rotation in response to longitudinal displacement of a plunger. The distributor is coupled to the plunger via a conventional tooth and cam arrangement, including an actuator cam follower having teeth which cooperate with corresponding teeth formed on a bottom portion of the plunger. The tooth and cam arrangement is designed to produce a 45-degree stepped rotation of the distributor in response to each up-down reciprocation of the plunger. The distributor is rotated during both the downward and upward displacements of the plunger.

In accordance with a first preferred embodiment of the invention, the distributor undergoes longitudinal displacement and stepped rotation. In accordance with a second preferred embodiment of the invention, the distributor undergoes stepped rotation without longitudinal displacement to ensure against unstable ON positions.

In both preferred embodiments the distributor has a radial flange at one end, with four extension arms circumferentially distributed at equal angular intervals on the periphery thereof, the extension arms being sized to lie within 45-degree circular sectors. After each 45-degree rotation, the distributor engages the first electrical contact element and alternatingly engages the extension arms of the second and then the third electrical contact elements, whereby the first electrical contact element is alternatingly electrically connected to the second or third electrical contact element.

In accordance with the second preferred embodiment, the first, second and third electrical contact elements are co-planar with insulating portions arranged to engage the distributor extension arms during their rotary transit from one contact point with one of the three electrical contact elements to the next such contact point. In other words, the upper surfaces of the insulating portions and the upper surfaces of the extension arms of the contact elements are co-planar and are arranged along the circumference traversed by the contacts on the distributor extension arms during rotation.

In accordance with the first preferred embodiment in which the distributor is longitudinally displaced, the electrical contact elements are not all co-planar and the distributor is instead always connected to one of the electrical contact elements via a spring arranged inside a cylindrical portion of the distributor. While a spring may be arranged in the cylindrical portion of the distributor in the second preferred embodiment, but unlike in the second preferred embodiment, that spring need not be conductive.

In accordance with both preferred embodiments of the invention, a second spring is arranged between a radial annular surface of the actuator cam follower and the radial annular flange of the distributor. This second spring urges the distributor against the top surface of the contact elements to ensure constant engagement of the distributor extension arms and the extension arms of the contact elements.

In accordance with the first preferred embodiment the tooth and cam arrangement is designed to produce a longitudinal displacement and a 45-degree stepped rotation of the distributor in response to each up-down reciprocation of the plunger. During the downward displacement of the plunger, the distributor disengages from the engaged electrical contact element; during the upward displacement of the plunger, the distributor engages the other electrical contact element. The distributor is rotated during both the downward and upward displacements of the plunger.

A housing for the foregoing component structures is provided which includes a base having a plurality of support pins and a central post which fixedly secure the contact elements within the housing against displacement. In the case of the first preferred embodiment, the central post further functions to support the distributor via a spring. Advantageously, secure arrangement of the contacts within the housing enhances the tolerance of terminals, to which the contacts are coupled, to pull-out by external forces and limits intermittancy associated with such pull-out forces. Further, manufacturing advantage is obtained by provision of a housing support of uncomplex design for mounting of switch components.

Other objects, features and advantages of the present invention will be apparent from the detailed description of the preferred embodiment of the invention which follows.

BRIEF DESCRIPTION OF THE DRAWINGS

The preferred embodiment of the invention will now be described in detail with reference to the drawings, wherein.

BEST MODE OF CARRYING OUT THE INVENTION

Figure 1:
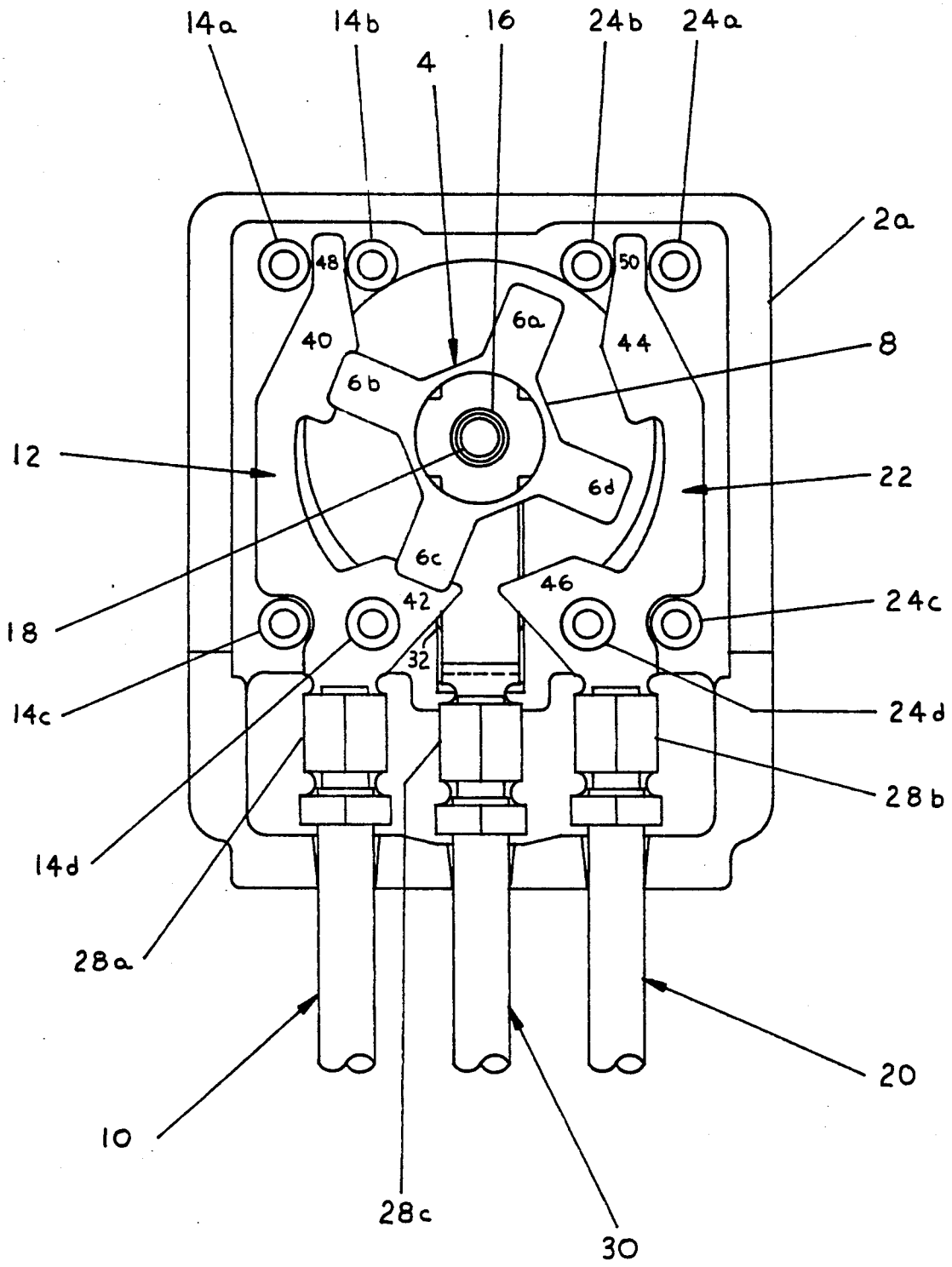
FIG. 1 is a top view showing the arrangement of the electrical contactor elements relative to the distributor in accordance with the first preferred embodiment of the invention.

FIG. 1 illustrates the details of construction and the arrangement of the stationary contacts relative to the rotary contact cup (distributor) and the switching action in accordance with the first preferred embodiment of the invention. As shown in FIG. 1, three stationary electrical contact elements 12, 22 and 32 are mounted on bottom portion 2*a* of housing 2. Contact elements 12, 22 and 32 may be made of any suitable electrically conductive material, such as copper. The housing 2 (see FIG. 2) is made of any suitable electrically insulating material, such as plastic.

Contact element 32 is electrically connected in direct contact to an electric terminal 30 and a voltage supply by means of a crimp coupling 28*c*. Similarly, contact elements 12 and 22 are respectively connected in electrical contact to electric terminals 10 and 20 by means of crimp couplings 28*a* and 28*b*. As will be set forth more fully hereinafter, contact elements 12, 22 and 32, respectively, are fixedly mounted within the housing against displacement by an arrangement of support pins 14*a*–14*d*, 24*a*–24*d* and a central post 18. This arrangement increases the tolerance of couplings 28*a*–*c* to external pull-out and limits intermittancy in switch operation associated with external forces. See FIG. 1.

Figure 2:
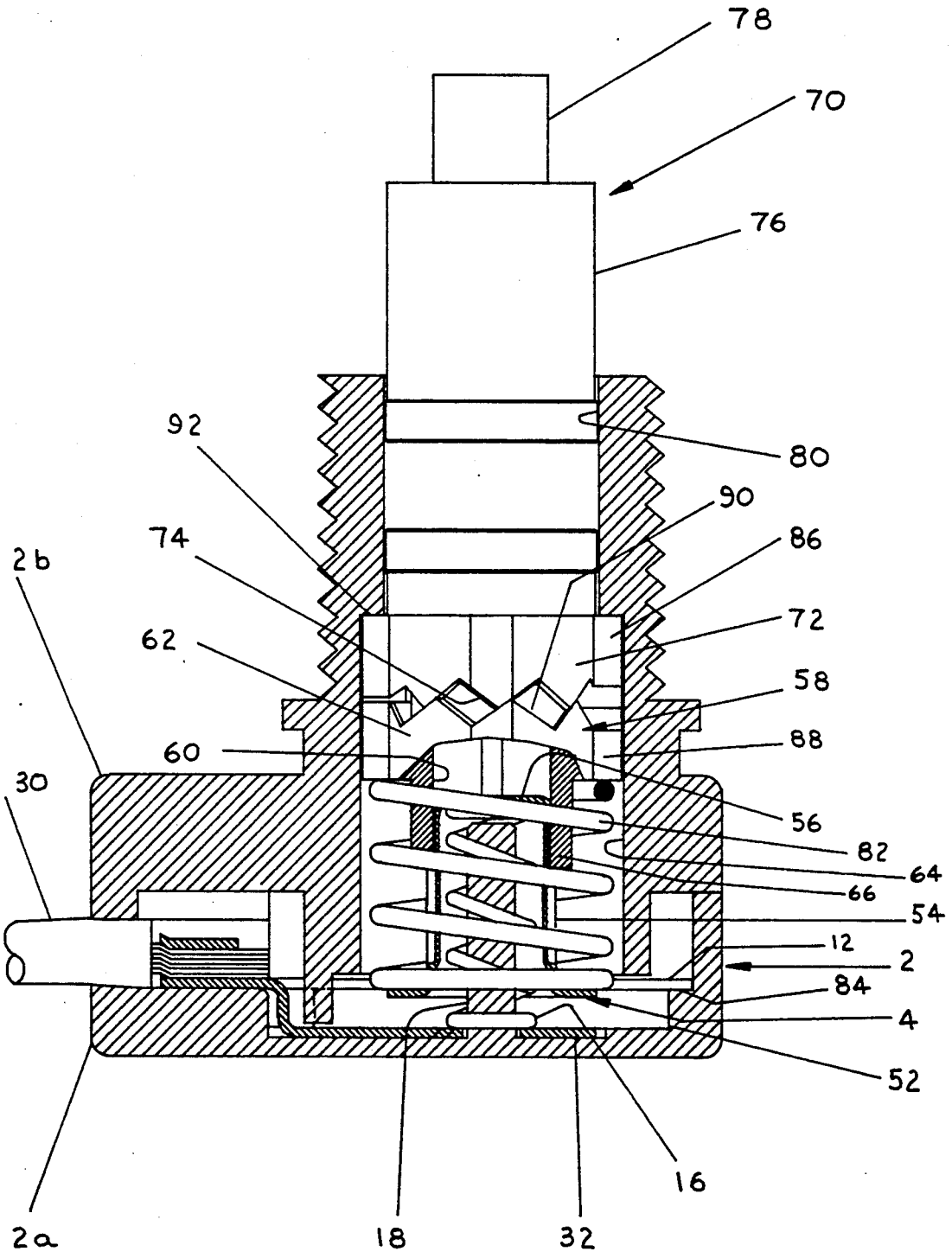
FIG. 2 is a partly sectioned side view of a high-profile version of the first preferred embodiment of the invention.

The portion of contact element 32 remote from electric terminal 30 is arranged in a recess 52 formed in the bottom housing portion 2a, as best seen in FIG. 2. Center post 18 is integrally formed on bottom housing portion 2a extends substantially perpendicular to the bottom surface of the recess 52 and along the axis of rotation of a distributor 4, which is in the form of a rotary contact cup. Contact 32 includes an opening which receives central post 18 for fixed positioning of the contact within the housing.

As best seen in FIG. 2, showing the high-profile version of the first preferred embodiment, a helical coil spring 16 is wound around the center post 18, which spring terminates in respective radial turns of the winding, the lower radial turn being in electrical contact with contact element 32 and the upper radial turn being in electrical contact with distributor 4. Thus, spring 16 electrically connects the distributor 4 with the contact element 32.

Distributor 4 is rotatably supported in an inverted position, with the axis of symmetry of a circular cylindrical portion 54 (see FIG. 2) generally aligned with the longitudinal axis of the switch. Spring 16 bears against the internal surface of the top portion 56 of distributor 4, urging the distributor in an upward longitudinal direction.

The cylindrical portion 54 of distributor 4 is seated inside a corresponding cylindrical bore 60 in actuator cam follower 58 for slidable longitudinal displacement relative thereto. In a conventional manner, the outer surface of the cylindrical portion 54 of distributor 4 and the inner surface of cylindrical bore 60 in actuator cam follower 58 are provided with cooperating splines and grooves which allow relative slidable longitudinal displacement of distributor 4 and actuator cam follower 58, but which blocks relative rotation thereof. Thus, distributor 4 rotates only when actuator cam follower 58 rotates.

In turn, the actuator cam follower 58 only rotates after an initial period of longitudinal displacement in response to downward longitudinal displacement of a plunger 70. In accordance with the high-profile push-push switch depicted in FIG. 2, plunger 70 comprises a first cylindrical portion 72 having a circumferential surface with four equally spaced external ribs 86 circumferentially distributed thereon, a second cylindrical portion 76 and a pushbutton 78. The first cylindrical portion 72 is seated in an upper portion of bore 64, which is provided with eight equally spaced longitudinal grooves, as explained in greater detail below. The external ribs 86 travel in four of this eight grooves during the downward stroke of plunger 70. The second cylindrical portion 76 is seated in a cylindrical bore 80 in the upper portion 2b of housing 2. In a conventional manner, the external ribs 86 and corresponding longitudinal grooves in bore 64 allow slidable longitudinal displacement and block rotation of plunger 70 relative to housing 2.

The actuator cam follower 58 has a cylindrical wall 66 with an outer circumferential surface of a first diameter and a toothed cylindrical portion 62 with an outer circumferential surface of a second diameter, the second diameter being greater than the first diameter (see FIG. 2). The toothed cylindrical portion 62 is seated coaxially inside top portion 2b of housing 2 for slidable longitudinal displacement and rotation relative thereto. In a conventional manner, a tooth and cam arrangement is provided whereby actuator cam follower 58 rotates only in response to longitudinal displacement of plunger 70 beyond a predetermined point. For example, U.S. Pat. No. 4,293,751 to Van Benthuysen et al. discloses a tooth and cam arrangement for causing stepped 45-degree rotation of the actuator cam follower 58 relative to the housing 2. That disclosure of the structure and operation of such an arrangement is specifically incorporated by reference herein.

In accordance with a tooth and cam arrangement as disclosed in U.S. Pat. No. 4,293,751 and as incorporated in the present invention, the upper portion of bore 64 in top portion 2b of housing 2 is provided with a series of eight equally spaced grooves formed by regularly spaced abutments formed on the inner wall surface thereof. The actuator cam follower 58 has four external ribs 88 circumferentially distributed on the outer circumferential surface of toothed cylindrical portion 62. Those external ribs cooperate with corresponding ones of the longitudinal grooves in the upper portion of bore 64 to enable the actuator cam follower 58 to slide longitudinally without rotation during the initial portion of the downward stroke of plunger 70.

As described in U.S. Pat. No. 4,293,751, the plunger 70 is provided with eight crowned teeth 74 at spaced intervals about the end of cylindrical portion 72. The actuator cam follower 58 also has eight crowned teeth 90 at spaced intervals about the end of cylindrical portion 62, which match the teeth 74 of plunger 70. During the initial portion of the downward stroke of plunger 70, the confronting teeth 74 and 90 engage each other without relative movement because rotation of both the plunger 7 and actuator cam follower 58 is blocked, as previously described. However, longitudinal grooves formed in bore 64 extend for only a predetermined length along the upper portion thereof. Accordingly, rotation of actuator cam follower 58 is blocked only until the point in the downward displacement of plunger 70 at which the external ribs 88 of actuator cam follower 58 disengage from the longitudinal grooves in bore 64. Once this axial clearance is effected, the crowned teeth 74 and 90 will cause the actuator cam follower 58 to rotate by an angle of approximately 22 degrees during the terminal portion of the downward stroke of plunger 70.

At the completion of the downward stroke of plunger 70, the respective crowned teeth 74 and 90 are fully internested. When the external force on pushbutton 78 is released, spring 82 is effective to restore the longitudinal position of plunger 70 and actuator cam follower 58 until shoulder 92 of plunger 70 abuts a corresponding shoulder formed between bores 64 and 80 of upper portion 2b of housing 2. During the upward longitudinal displacement of plunger 70 and actuator cam follower 58, respective inclined cam surfaces on the inner wall abutments of bore 64 act against the external ribs 88 of actuator cam follower 58 to bias the latter an additional angular increment of 23 degrees, so that the final relative position of the plunger 70 and actuator cam follower 58 is again the same as the initial position assumed at the start of the above-described downward stroke.

Returning to FIG. 1, it can be seen that distributor 4 has a radial flange 8 and a plurality of co-planar radial extension arms 6a through 6d which are circumferentially distributed at equal angular intervals on the periphery of flange 8. For the sake of facilitating this description of the invention, distributor 4 can be divided into eight 45-degree angular sectors centered at the axis of rotation thereof. Each of the four extension arms lies within a corresponding 45-degree angular sector, each extension arm being separated from adjacent extensions arms by another 45-degree angular sector.

In addition to contact element 32, the push-push switch in accordance with the invention has contact elements 12 and 22 respectively electrically connected to electric terminals 10 and 20 by means of couplings 28*a* and 28*b*. Contact element 12 is secured by support pins 14*a* through 14*d* and contact element 22 is secured by support pins 24*a* through 24*d*. Contact element 12 comprises a first extension arm 48 located between support pins 14*a* and 14*b*, a second extension arm 40 overlying a seventh of eight hypothetical 45-degree angular sectors extending radially from the axis of rotation of contact cup 4 and a third extension arm 42 overlying a fifth hypothetical 45-degree angular sector, as depicted in FIG. 1. Similarly, contact element 22 comprises a first extension arm 50 located between support pins 24*a* and 24*b*, a second extension arm 44 overlying a second hypothetical 45-degree angular sector and a third extension arm 46 overlying a fourth hypothetical 45-degree angular sector. Each of extension arms 40, 42, 44 and 46 has a radially inner portion which lies within a circle centered at the axis of rotation of distributor 4 and having a radius equal to the distance between the axis of rotation and the outer circumferential edge of extension arms 6*a* through 6*d* of distributor 4.

It is a feature of the invention to provide a switch in which all components are mounted on the housing base. As shown in FIG. 1, contacts 12, 22 and 32 as well as the distributor are mounted on the housing base. Further, simplicity in design and consequent manufacturing advantage is obtained by the arrangement of the central post 18 and support pins 14*a*–14*d* and 24*a*–24*d* which respectively secure contacts 12, 22 and 32 against displacement in the housing. Secure arrangement of the contacts enhances the tolerance of the terminals 10, 20 and 30 to pull-out by external forces and limits intermittancy associated with such pull-out forces.

In accordance with the first preferred embodiment of the invention, spring 82 is compressed in response to downward longitudinal displacement of actuator cam follower 58. The distributor 4 in turn undergoes downward longitudinal displacement when the downward force exerted by compressed spring 82 overcomes the resistance of spring 16 and thereafter undergoes rotation when actuator cam follower 58 rotates. After the distributor has rotated a predetermined number of degrees, it undergoes upward longitudinal displacement in response to the release of spring 82 and the restorative force of spring 16. At its equilibrium position after termination of the upward displacement and before the start of the next downward displacement, distributor 4 is longitudinally positioned such that a pair of its extension arms 6*a* through 6*d* underlie and correspondingly engage either the extension arms 40 and 42 of contact element 12 or the extension arms 44 and 46 of contact element 22. Spring 16 urges the extension arms of distributor 4 against the extension arms of the engaged contact element to ensure a positive electrical connection therebetween.

In response to each up-down reciprocation of plunger 70, the distributor 4 is rotated 45 degrees in the counterclockwise direction. Alternatively, the tooth and cam arrangement can be such that the stepped rotation is in the clockwise direction. In the angular position depicted in FIG. 1, extension arms 6*b* and 6*c* of distributor 4 engage extension arms 40 and 42 respectively of contact element 12, thereby closing the circuit between contact elements 12 and 32 via series-connected spring 16 and distributor 4. If the plunger 70 is depressed and released, then distributor 4 will be rotated 45 degrees in the clockwise direction. In the new angular position, extension arms 6*c* and 6*d* of distributor 4 engage extension arms 46 and 44 respectively of contact element 22, thereby closing the circuit between contact elements 22 and 32. If the plunger 70 is again depressed and released, then distributor 4 will be rotated another 45 degrees in the clockwise direction. In this third angular position, extension arms 6*a* and 6*b* of distributor 4 engage extension arms 40 and 42 respectively of contact element 22, thereby again closing the circuit between contact elements 22 and 12. If the plunger 70 is depressed and released a third time, then distributor 4 will be rotated another 45 degrees in the clockwise direction. In this fourth angular position, extension arms 6*b* and 6*c* of distributor 4 engage extension arms 46 and 44 respectively of contact element 22, thereby again closing the circuit between contact elements 22 and 32. Thus, it can be seen that for each successive up-down reciprocation of the plunger, the push-push switch in accordance with the invention will alternatingly electrically connect electrical terminals 10 and 20 to electric terminal 30.

Figure 3:
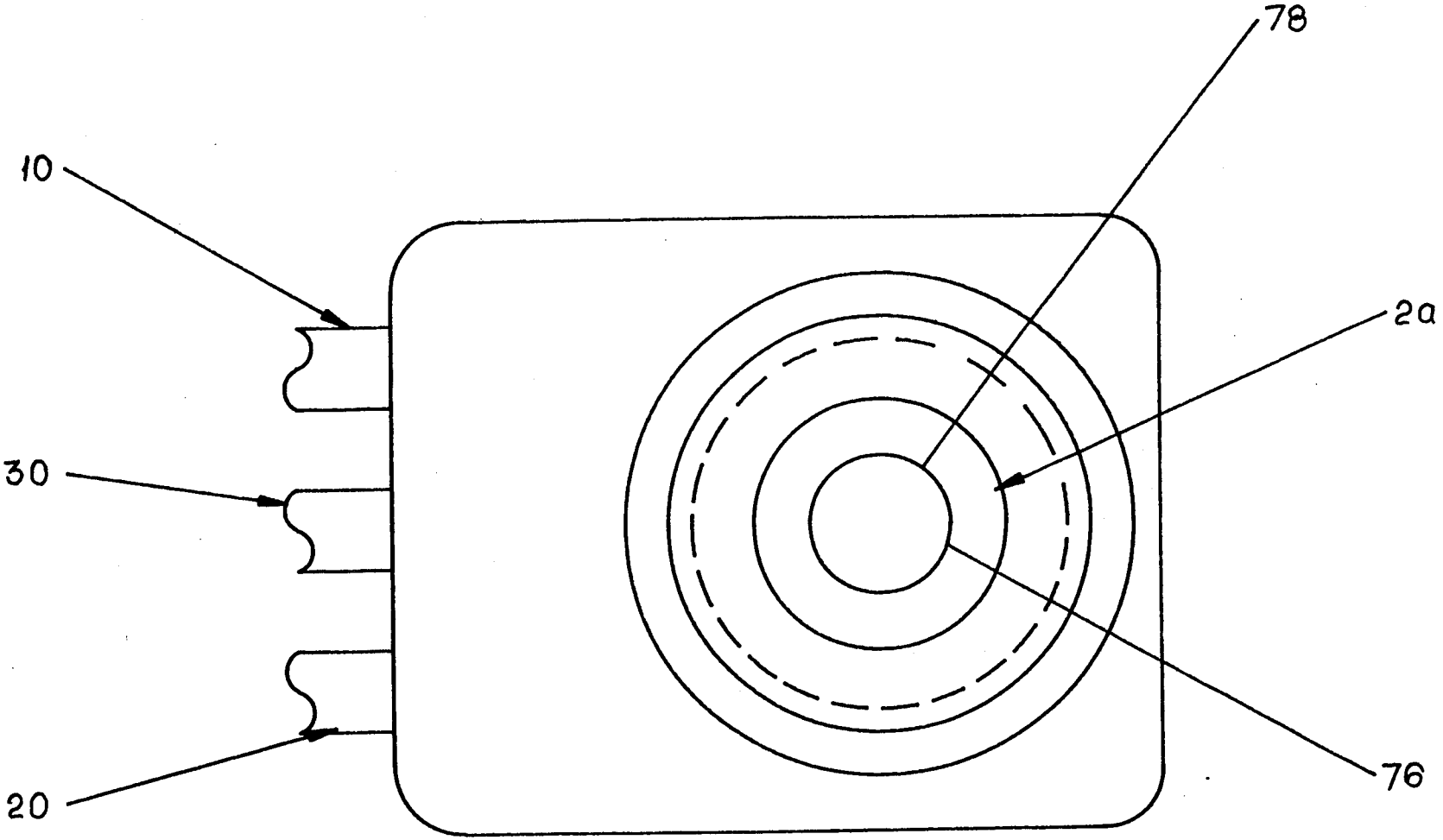
FIG. 3 is a top view of the high-profile version of the first preferred embodiment of the invention depicted in FIG. 2.
Figure 4:
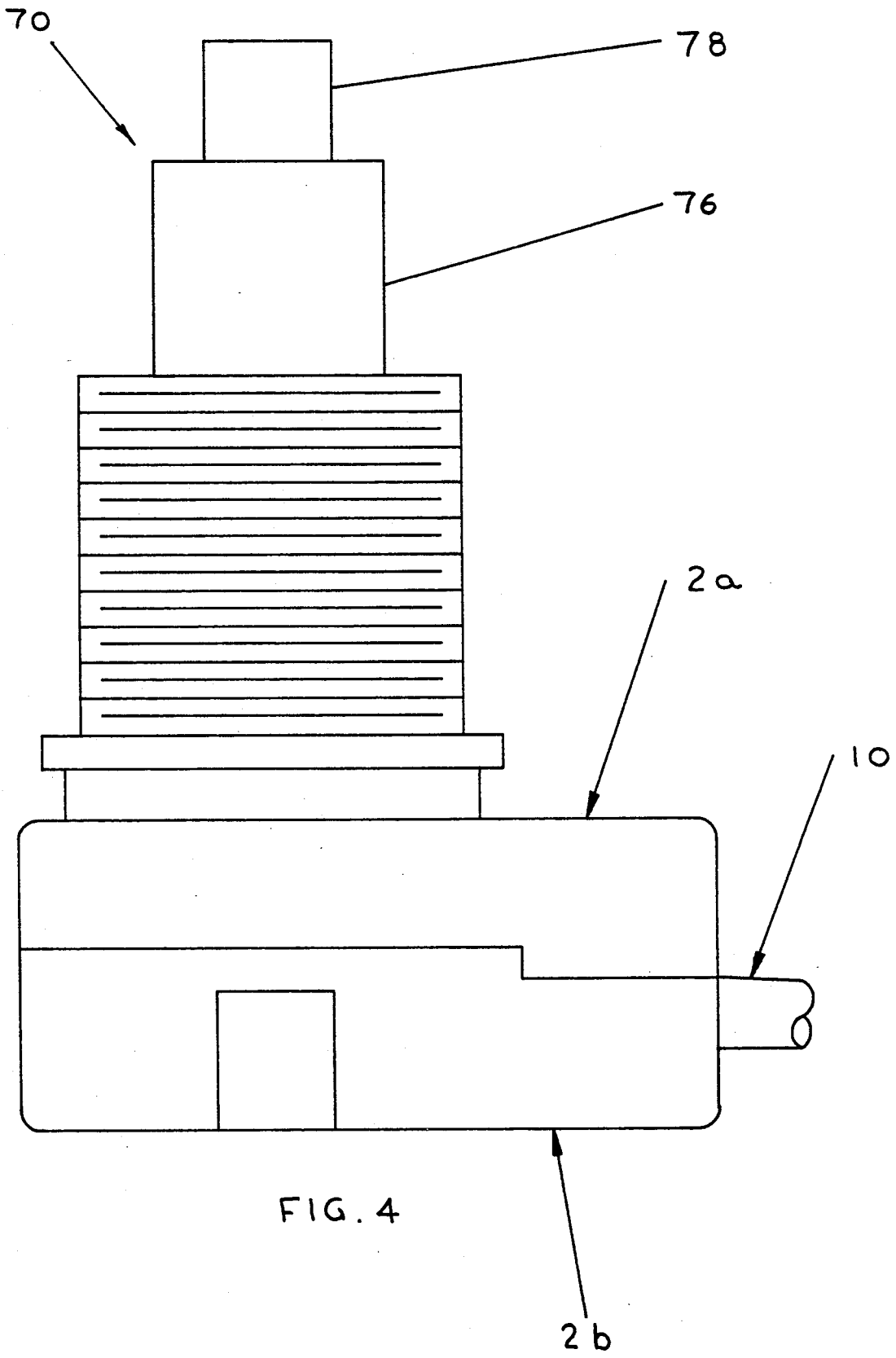
FIG. 4 is a side view of the high-profile version of the first preferred embodiment depicted in FIG. 2.
Figure 5:
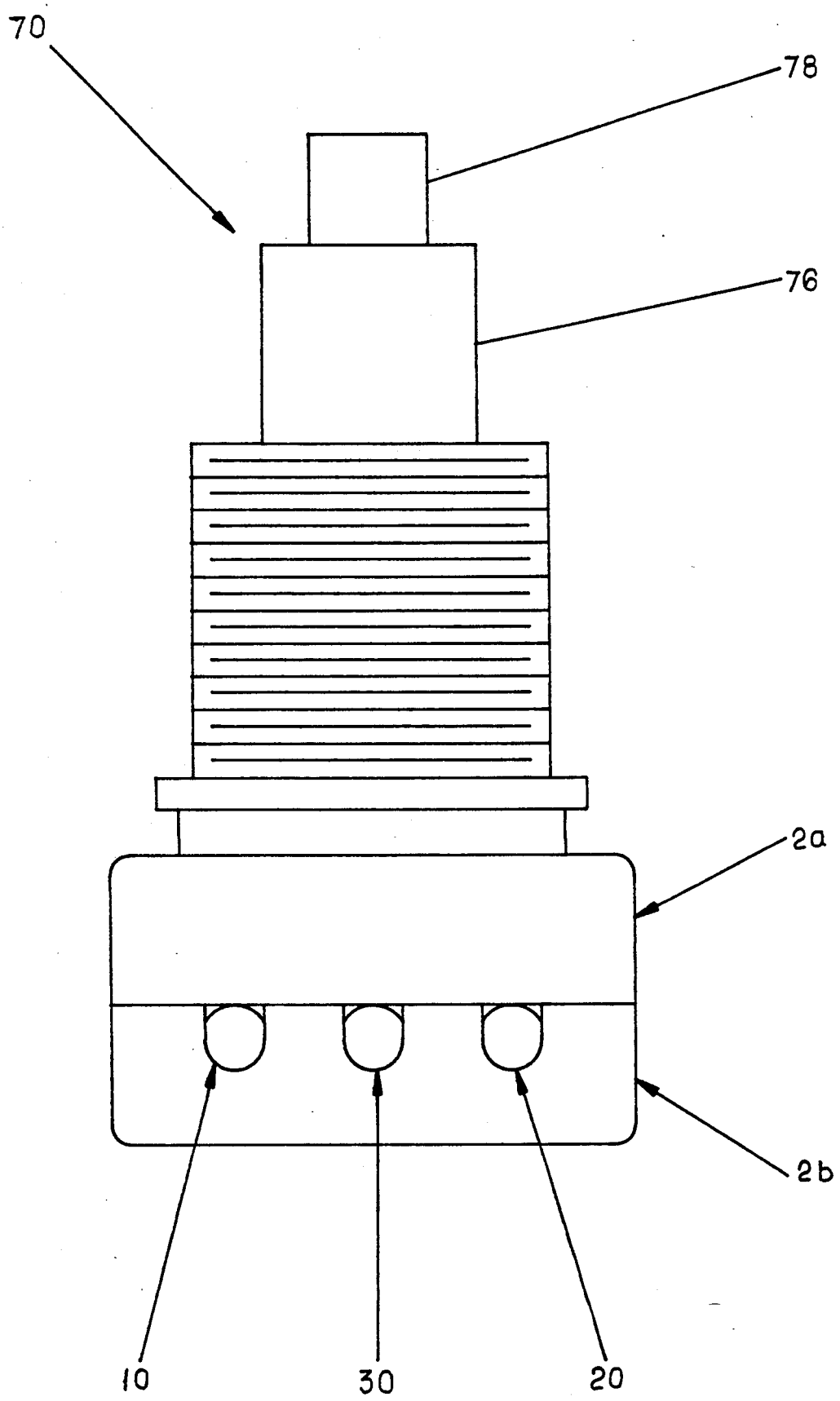
FIG. 5 is an end view of the high-profile version of the first preferred embodiment depicted in FIG. 2.

Top, side and end views of the high-profile version of the first preferred embodiment depicted in FIG. 2 are shown in FIGS. 3 through 5 respectively.

Figure 6:
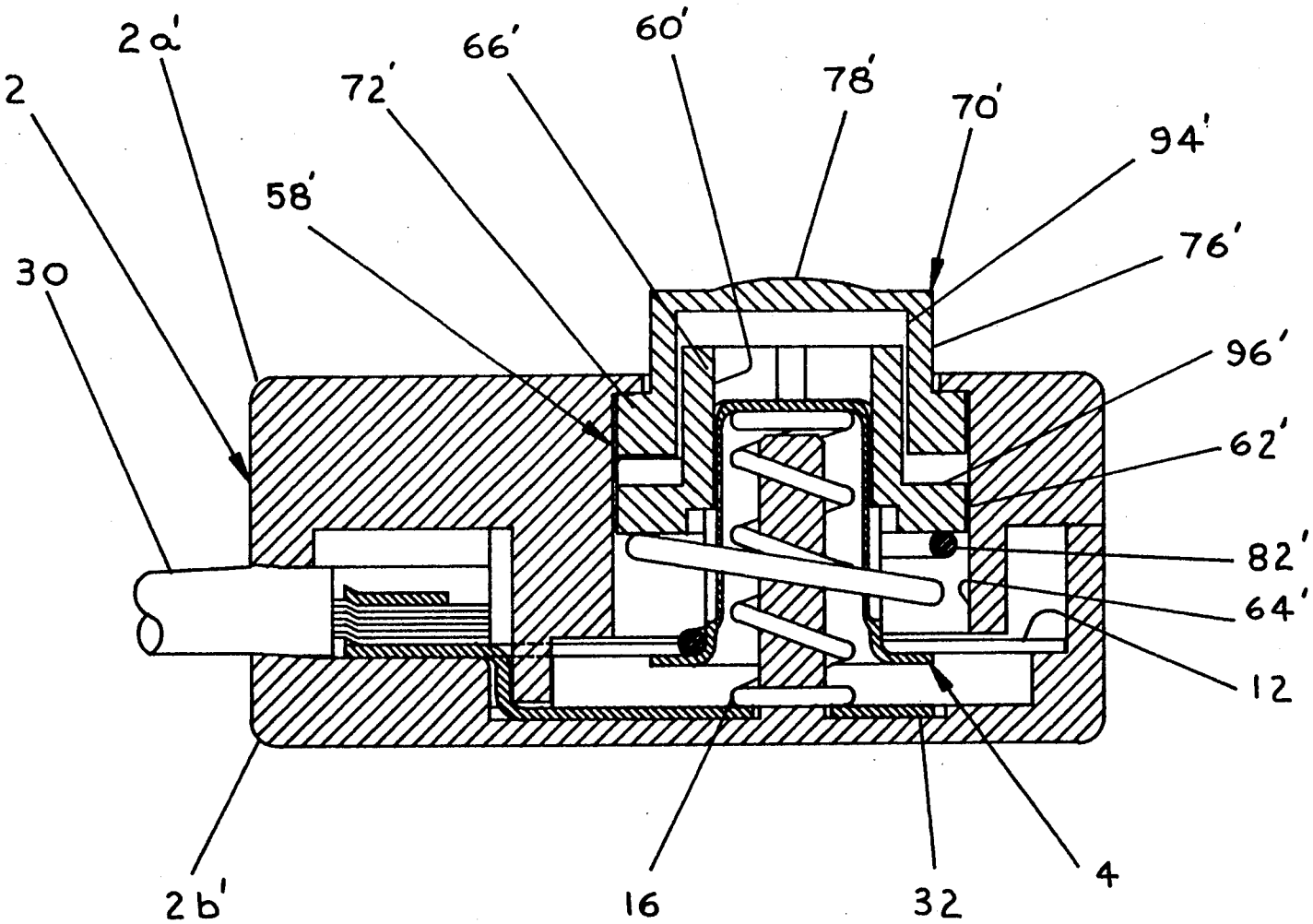
FIG. 6 is a partly sectioned side view of a low-profile version of the first preferred embodiment of the invention.

FIG. 6 is a sectional view showing the structural details of the low-profile version of the first preferred embodiment of the invention. Those elements have the same structure as the corresponding elements of the high-profile embodiment shown in FIG. 2 bear the same reference numeral and will not be described again here. Those elements have a modified structure as compared to the structure of the corresponding elements of the high-profile embodiment shown in FIG. 2 bear the same reference numeral with an apostrophe added.

The low-profile embodiment depicted in FIG. 6 differs in structure from that of the high-profile embodiment depicted in FIG. 2 in that plunger 70' and bore 64' are reduced in height, spring 82' is reduced in length (i.e., number of turns) and plunger 70' and actuator cam follower 58' have different structures which enable actuator cam follower 58' to be slidably seated in a longitudinal cylindrical bore formed in plunger 70'.

Plunger 70' comprises a first cylindrical portion 72' having a first outer diameter and a first inner diameter, and a second cylindrical portion 76' having a second outer diameter and the first inner diameter, the second outer diameter being less than the first outer diameter and the first inner diameter being the diameter of cylindrical bore 64'. One end of the second cylindrical portion 76' is closed by pushbutton 78', which takes the form of a spherical mound formed on a radial surface.

Actuator cam follower 58' comprises a first cylindrical portion 62' having the first outer diameter and a second inner diameter, and a second cylindrical portion 66' having a third outer diameter and the second inner diameter, the third outer diameter being slightly less than the first inner diameter and the second inner diameter being the diameter of cylindrical bore 60'.

The second cylindrical portion 66' of actuator cam follower 58' is slidably seated in cylindrical bore 94 of plunger 70'. The distributor 4 is slidably seated in cylindrical bore 60' of actuator cam follower 58'. As previously described, the outer surface of distributor 4 and the inner surface of cylindrical bore 60' of actuator cam follower 58' are provided with grooves and external ribs for allowing relative slidable displacement and blocking relative rotation of distributor 4 and actuator cam follower 58'. Also the outer surface of cylindrical portion 72' of plunger 70' and the inner surface of cylindrical bore 64' of the top portion 2a' of housing 2' are provided with grooves and external ribs for allowing slidable displacement and blocking rotation of plunger 70' relative to housing 2'.

Furthermore, a conventional tooth and cam arrangement, as previously described, is provided for obtaining stepped rotation of actuator cam follower 58' in response to up-down reciprocation of plunger 70'. For example, opposing crowned teeth are provided on annular radial surfaces 96 and 98 of first cylindrical portion 62' of actuator cam follower 58' and first cylindrical portion 72' of plunger 70'. Similarly, actuator cam follower 58' has external ribs which cooperate with slots and camming surfaces formed on the inner surface of cylindrical bore 64' of housing 2' to ensure longitudinal displacement without rotation of actuator cam follower 58' relative to housing 2' during an initial portion of the downward stroke of plunger 70' and rotation of the actuator cam follower 58' relative to housing 2' during a portion of the upward stroke of plunger 70' at the urging of spring 16.

Figure 7:
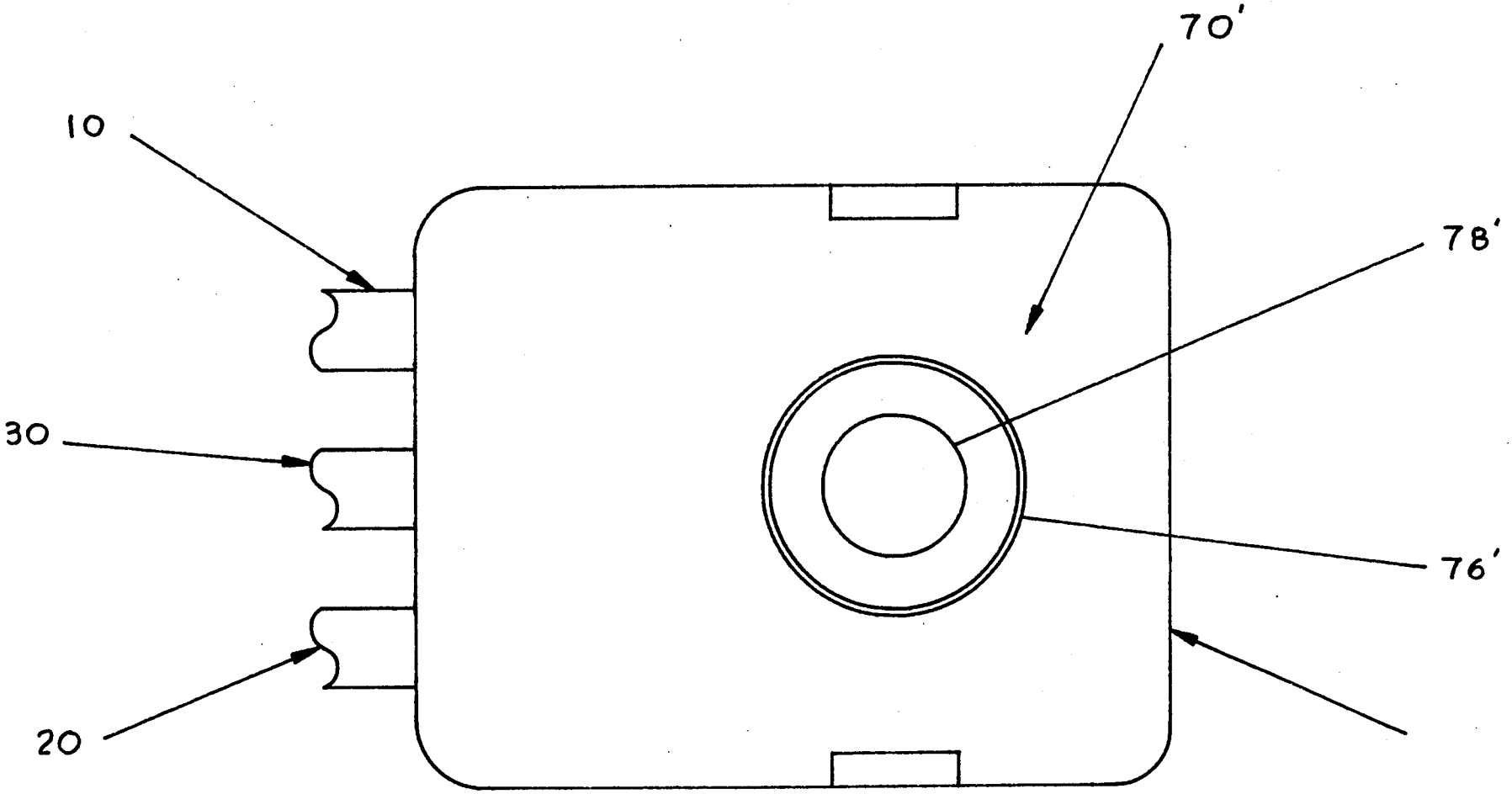
FIG. 7 is a top view of the low-profile version of the first preferred embodiment of the invention depicted in FIG. 6.
Figure 8:
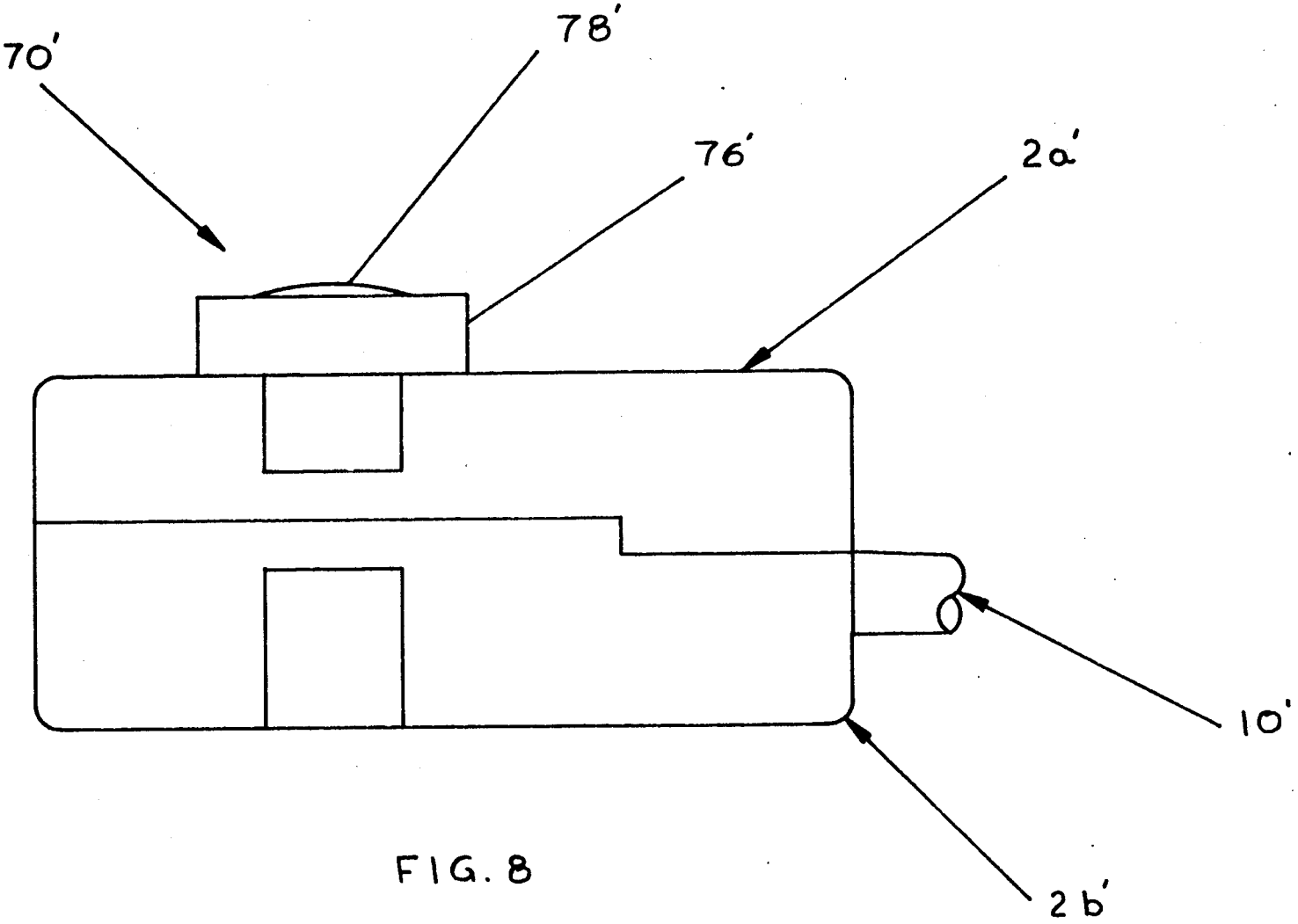
FIG. 8 is a side view of the low-profile version of the first preferred embodiment depicted in FIG. 6.
Figure 9:
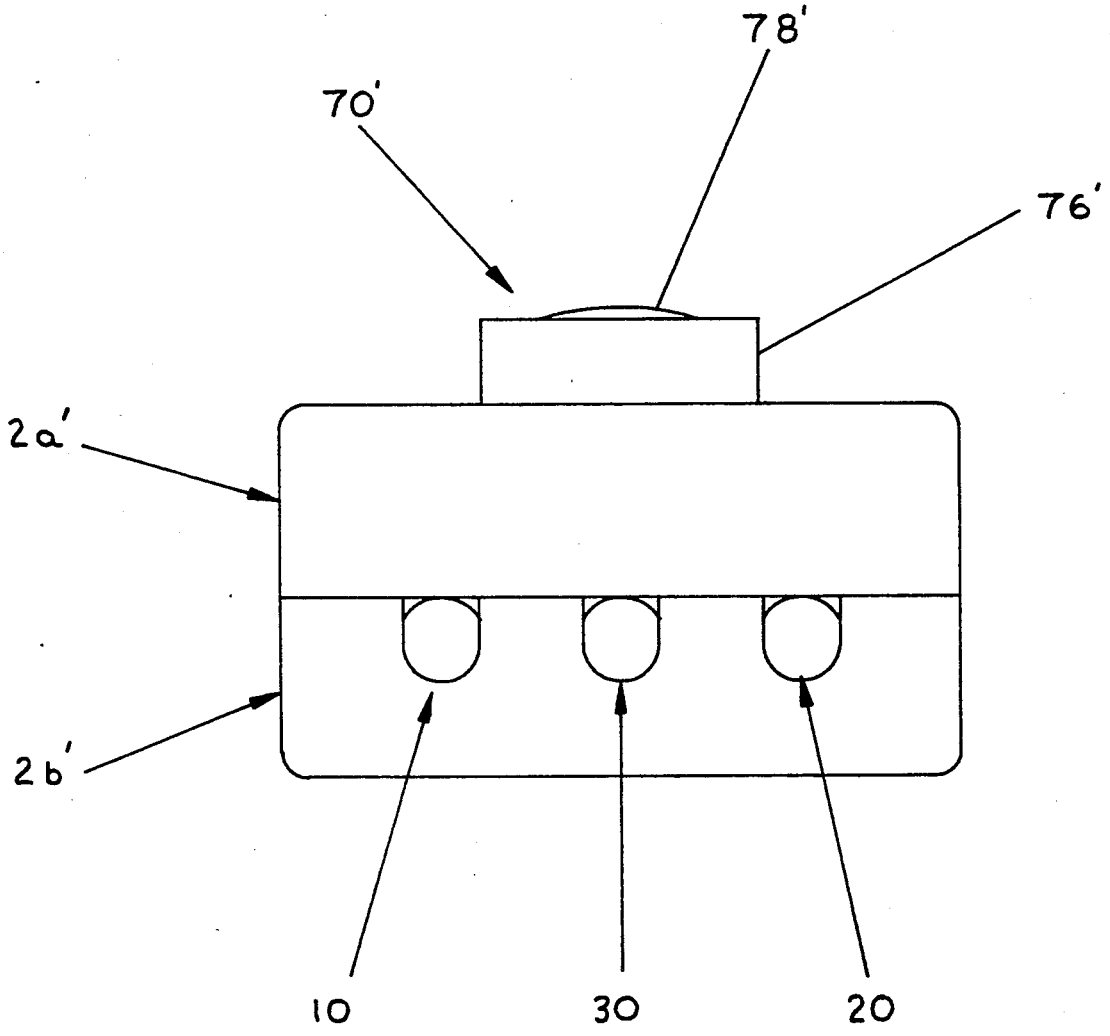
FIG. 9 is an end view of the low-profile version of the first preferred embodiment depicted in FIG. 6.

Top, side and end views of the low-profile version of the first preferred embodiment depicted in FIG. 6 are shown in FIGS. 7 through 9 respectively.

Figure 10:
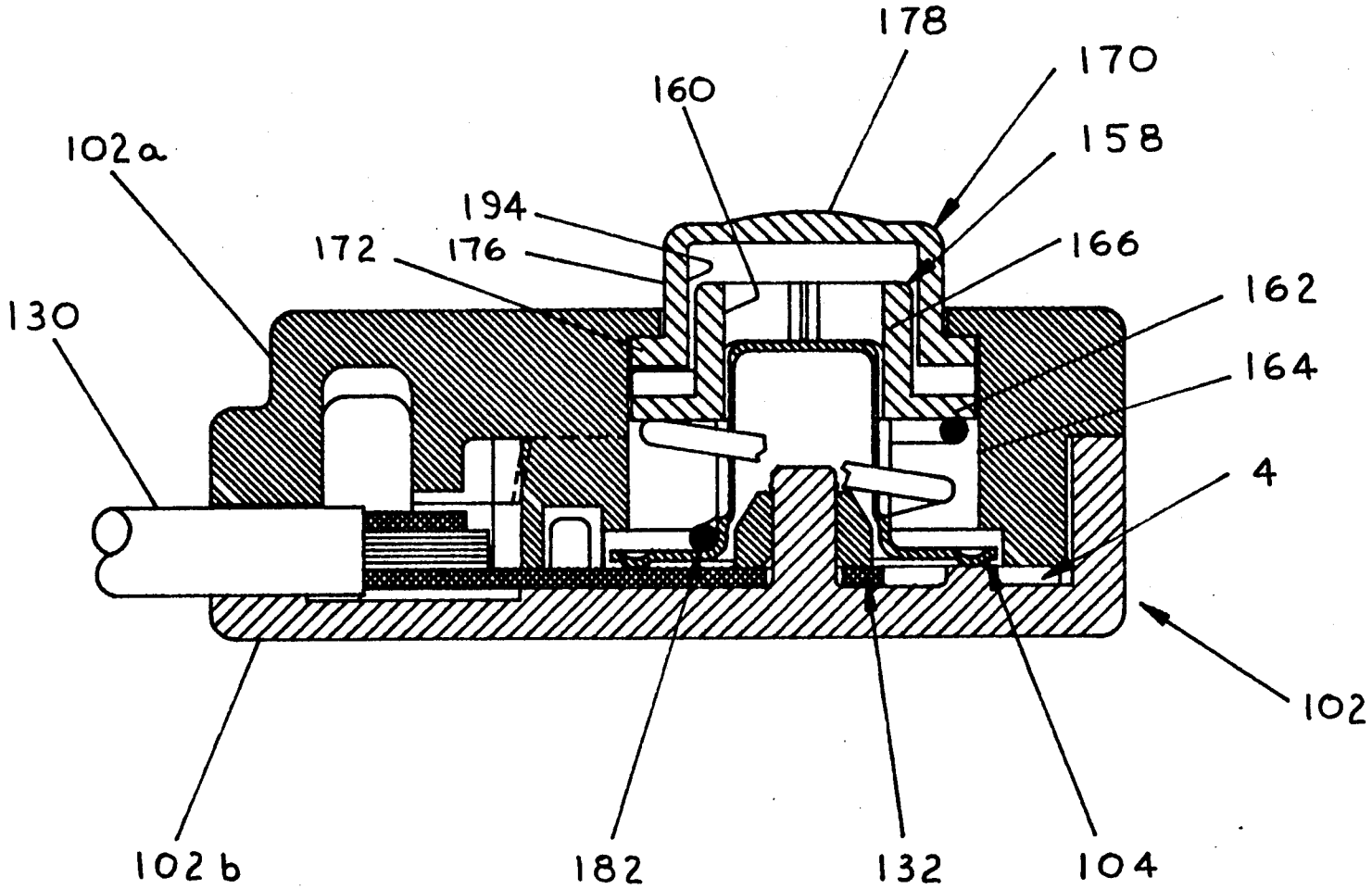
FIG. 10 is a sectional view of a low-profile version of a second preferred embodiment of the invention.

FIG. 10 is a sectional view showing the structural details of the low-profile version of the second preferred embodiment of the invention. This embodiment differs from the low-profile embodiment depicted in FIG. in that the distributor undergoes stepped rotation without longitudinal displacement, thereby ensuring a stable ON position. This is accomplished by placing the distributor above the contact elements instead of below so that the distributor is urged against and rides atop the contact elements during rotation. This arrangement also eliminates the arcing phenomena which occur when the distributor is moved longitudinally away from engagement with a contact element.

The low-profile embodiment depicted in FIG. 10 is similar in structure to the low-profile embodiment depicted in FIG. 6. Plunger 170 and bore 164 are reduced in height, spring 182 is reduced in length (i.e., number of turns) and plunger 170 and actuator cam follower 158 have structures which enable actuator cam follower 158 to be slidably, seated in a longitudinal cylindrical bore 194 formed in plunger 170.

Plunger 170 comprises a first cylindrical portion 172 having a first outer diameter and a first inner diameter, and a second cylindrical portion 176 having a second outer diameter and the first inner diameter, the second outer diameter being less than the first outer diameter and the first inner diameter being the diameter of cylindrical bore 164. One end of the second cylindrical portion 176 is closed by pushbutton 178, which takes the form of a spherical mound formed on a radial surface.

Actuator cam follower 158 comprises a first cylindrical portion 162 having the first outer diameter and a second inner diameter, and a second cylindrical portion 166 having a third outer diameter and the second inner diameter, the third outer diameter being slightly less than the first inner diameter and the second inner diameter being the diameter of cylindrical bore 160.

The second cylindrical portion 166 of actuator cam follower 158 is slidably seated in cylindrical bore 194 of plunger 170. The distributor 104 is slidably seated in cylindrical bore 160 of actuator cam follower 158. As previously described, the outer surface of distributor 104 and the inner surface of cylindrical bore 160 of actuator cam follower 158 are provided with grooves and external ribs for allowing relative slidable displacement and blocking relative rotation of distributor 104 and actuator cam follower 158. Also the outer surface of cylindrical portion 172 of plunger 170 and the inner surface of cylindrical bore 164 of the top portion 102a of housing 102 are provided with grooves and external ribs for allowing slidable displacement and blocking rotation of plunger 170 relative to housing 102.

Furthermore, a conventional tooth and cam arrangement, as previously described, is provided for obtaining stepped rotation of actuator cam follower 158 in response to up-down reciprocation of plunger 170. For example, opposing crowned teeth are provided on annular radial surfaces of first cylindrical portion 162 of actuator cam follower 158 and first cylindrical portion 172 of plunger 170. Similarly, actuator cam follower 158 has external ribs which cooperate with slots and camming surfaces formed on the inner surface of cylindrical bore 164 of housing 102 to ensure longitudinal displacement without rotation of actuator cam follower 158 relative to housing 102 during an initial portion of the downward stroke of plunger 170 and rotation of the actuator cam follower 158 relative to housing 102 during a portion of the upward stroke of plunger 170.

Figure 11:
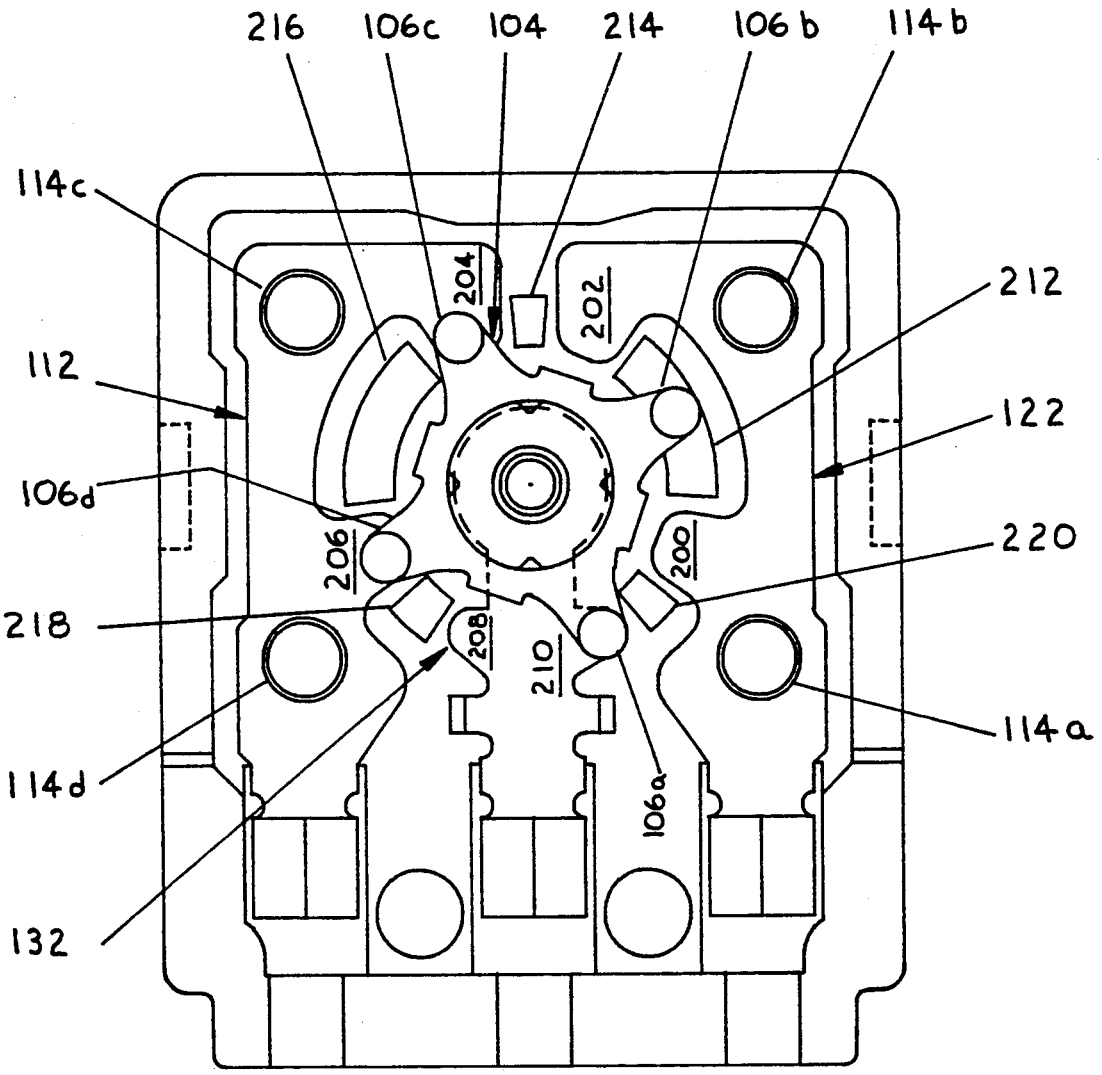
FIG. 11 is a top view of the distributor and lower housing portion of the low-profile version of the second preferred embodiment depicted in FIG. 10.

A top view of the low-profile version of the second preferred embodiment depicted in FIG. 10 is shown in FIG. 11 with the upper housing portion, plunger, actuator cam follower and spring removed. Central contact element 132, which has an aperture which fits over the central stem 118, is secured to the lower housing portion 102b. The dashed lines indicate the structure of that portion of the contact element 132 which underlies the distributor 104 Left and right contact elements 112 and 122 likewise are secured to lower housing portion 102b.

As previously described, the distributor undergoes stepped rotations of 45 degrees. The distributor has the shape of an inverted cup with a radial flange at the open end. Four extension arms 106a through 106d extend radially from the periphery of the radial flange and are circumferentially distributed at equal angular intervals. A spherical projection formed at the end of each radial extension arm serves as the contact for engaging the respective contact elements 112, 122 and 132.

After each 45-degree rotation of the distributor the contact projection of each radial extension arm is located at one of eight predetermined positions along a circular path. At the first predetermined position the contact projection engages a contact portion 200 of contact element 122; at the second predetermined position the contact projection engages an insulating portion 212 which is integrally formed on the lower housing portion 102b; at the third predetermined position the contact projection engages a contact portion 202 of contact element 122; at the fourth predetermined position the contact projection engages a contact portion 204 of contact element 112; at the fifth predetermined position the contact projection engages an insulating portion 216 which is integrally formed on the lower housing portion 102b; at the sixth predetermined position the contact projection engages a contact portion 206 of contact element 112; at the seventh predetermined position the contact projection engages a contact portion 208 of contact element 132; and at the eighth predetermined position the contact projection engages a contact portion 210 of contact element 132. At each of the eight predetermined positions, the distributor has one radial extension arm which engages the central contact element 132, two radial extension arms which engage two contact portions of either the left or the right contact element 112 or 122, and one radial extension arm which engages an insulating portion of the lower housing portion.

Insulating portions 212 and 216 ar annular segments which support the opposing contact projection during sliding along an arc of a predetermined angle, preferably 50 to 60 degrees. In addition, an insulating portion 214 is arranged between contact portions 202 and 204; an insulating portion 218 is arranged between contact portions 206 and 208; and an insulating portion 220 is arranged between contact portions 210 and 200. Each of insulating portions 214, 218 and 220, like insulating portions 212 and 216, are integrally formed as part of the lower housing portion 102*b*.

In accordance with this arrangement, the distributor rotates without longitudinal displacement. During that rotation the contacts slide circumferentially over the conductive contact portions 200, 202, 204, 206, 208 and 210 of the contact elements and insulating portions 212, 214, 216, 218 and 220 of the lower housing portion 102*b*, which are all co-planar, to effect operation of the switch.

Although not depicted in FIG. 10, a second spring can be mounted on the central stem 118 to urge the distributor 104 in the upward longitudinal direction, thereby reducing the frictional force exerted on the contacts of the radial extension arms of the distributor during sliding of the contacts over the alternating electrical contacts and insulating portions.

Although the invention has been described with reference to certain preferred embodiments, it will be appreciated that other apparatus may be devised which are nevertheless within the scope and spirit of the invention as defined in the claims appended hereto. For example, it is not necessary to practice of the invention that the magnitude of the stepped rotation be 45 degrees. By providing fewer or more teeth and camming surfaces on the plunger, actuator cam follower and housing, the magnitude of the stepped rotation can be made equal to an angle of 360/n degrees, where n is the number of teeth.

Similarly, the preferred embodiments employ a terminals 10, 20 and 30 which are coupled to switch contacts 12, 22, and 32 by conventional crimp attachment. It will be recognized that other mechanisms may be employed to effect terminal contacts. By way of example, the contacts may be adapted projecting prongs for coupling to printed circuit boards.

Therefore, although the invention has been described with reference to certain preferred embodiments, it will be appreciated that other modifications thereof may be devised, which are nevertheless within the scope and spirit of the invention as defined in the claims appended hereto.

We claim:

1. A push-push electrical switch for switching between first and second electrical states, comprising:

a housing made of insulating material, said housing having a cylindrical bore with a longitudinal axis and first camming means formed in said bore;

a plunger slidably arranged within said bore of said housing for longitudinal displacement without rotation relative to said housing, said plunger having second camming means arranged on an end face thereof;

an actuator cam follower slidably arranged within said bore of said housing for longitudinal displacement and rotation relative to said housing, said actuator cam follower having a cylindrical bore formed along said cylindrical axis and third and fourth camming means formed thereon, said third camming means engaging said second camming means during downward longitudinal displacement of said plunger and said fourth camming means engaging said first camming means during upward longitudinal displacement of said plunger;

a distributor made of electrically conductive material for switching between said first and second electrical states, said distributor being slidably arranged within said cylindrical bore of said actuator cam follower for longitudinal displacement without rotation relative to said actuator cam follower and arranged within said housing for rotation relative thereto, said distributor comprising a cylindrical portion, a radial flange formed at an end of said cylindrical portion of said distributor, and a plurality of radial extension arms circumferentially distributed at equal angular intervals on a periphery of said radial flange, each extension arm having a contact portion which travels along a circular path during rotation of said distributor;

first, second and third electrical contacts supported by said housing and having respective contact portions arranged along the circular path of travel of said contact portions of said distributor, said contact portions of said first, second and third electrical contacts being substantially co-planar;

insulating means arranged between said contact portions of first, second and third electrical contacts along the circular path of travel of said contact portions of said distributor, said insulating means being substantially co-planar with said co-planar contact portions of said first, second and third electrical contacts;

a helical spring having one end abutting said actuator and another end abutting said distributor, said helical spring alternatingly pressing said contact portions of said distributor against opposing portions of said contact portions of said first, second and third electrical contacts and opposing portions of said insulating means during rotation of said distributor;

wherein said distributor rotates about said longitudinal axis a first predetermined angle relative to said housing, from a first angular position corresponding to said first electrical state to a second angular position corresponding to said second electrical state, by cooperation of said second and third camming means during downward longitudinal displacement of said plunger and cooperation of said first and fourth camming means during upward longitudinal displacement of said plunger, whereby said distributor electrically couples said first electrical contact to said second electrical contact in said first electrical state and couples said first electrical contact to said third electrical contact in said second electrical state.

2. The push-push electrical switch as defined in claim 1, wherein the number of said plurality of radial extension arms equals four and each of said electrical contacts comprises two extension arms, two extension arms of said distributor engaging two extension arms of either of said contacts at every one of a plurality of angular positions of said distributor.

3. The push-push electrical switch as defined in claim 1, wherein said actuator cam follower has a cylindrical portion slidably seated in a cylindrical bore formed in said plunger.

4. The push-push electrical switch as defined in claim 1, wherein cylindrical portion of said distributor is slidably seated in a cylindrical bore formed in said actuator cam follower.

5. The push-push electrical switch as defined in claim 1, wherein said housing comprises a base portion having a first plurality of support pins arranged to block displacement of said second electrical contact in a plane substantially perpendicular to said longitudinal axis and a second plurality of support pins arranged to block displacement of said third electrical contact in a plane substantially perpendicular to said longitudinal axis.

6. The push-push electrical switch as defined in claim 1, wherein said helical spring is wound around said cylindrical portion of said distributor.

7. The push-push electrical switch as defined in claim 1, wherein said distributor has arranged so that at each of said eight predetermined stepped angular positions, one of said radial extension arms engages said first electrical contact, another of said radial extension arms engages said insulating means, and the remaining two of said radial extension arms engage respective contact portions of either said second electrical contact or said third electrical contract.

* * * * *